US009394765B2

(12) United States Patent
Least et al.

(10) Patent No.: US 9,394,765 B2
(45) Date of Patent: Jul. 19, 2016

(54) GRAVEL PACKING APPARATUS HAVING LOCKING JUMPER TUBES

(71) Applicant: Halliburton Energy Services, Inc., Houston, TX (US)

(72) Inventors: Brandon Thomas Least, Dallas, TX (US); Gregory Scott Cunningham, Grapevine, TX (US); Jean Marc Lopez, Plano, TX (US); Jan Veit, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 273 days.

(21) Appl. No.: 14/029,033

(22) Filed: Sep. 17, 2013

(65) Prior Publication Data

US 2014/0158373 A1 Jun. 12, 2014

(30) Foreign Application Priority Data

Dec. 7, 2012 (WO) ..... PCT/US2012/068524

(51) Int. Cl.

| | |
|---|---|
| ***E21B 43/04*** | (2006.01) |
| ***E21B 43/08*** | (2006.01) |
| ***E21B 43/10*** | (2006.01) |
| ***E21B 17/046*** | (2006.01) |
| ***E21B 17/07*** | (2006.01) |

(52) U.S. Cl.

CPC ..... *E21B 43/04* (2013.01); *E21B 17/046* (2013.01); *E21B 17/07* (2013.01); *E21B 43/08* (2013.01); *E21B 43/10* (2013.01)

(58) Field of Classification Search

CPC ..... E21B 43/04; E21B 43/08; E21B 43/082; E21B 43/086; E21B 43/088; E21B 43/10

See application file for complete search history.

(56) References Cited

U.S. PATENT DOCUMENTS

| | | | | |
|---|---|---|---|---|
| 5,042,848 | A * | 8/1991 | Shiozaki | F16L 37/133 285/277 |
| 5,390,966 | A | 2/1995 | Cox et al. | |
| 5,476,143 | A * | 12/1995 | Sparlin | E21B 43/088 166/233 |
| 5,868,200 | A | 2/1999 | Bryant et al. | |
| 6,298,916 | B1 | 10/2001 | Tibbles et al. | |

(Continued)

FOREIGN PATENT DOCUMENTS

EP 0622523 A2 2/1994

OTHER PUBLICATIONS

International Search Report and Written Opinion, KIPO, PCT/US2012/068524, Aug. 22, 2013.

(Continued)

*Primary Examiner* — Cathleen Hutchins

(74) *Attorney, Agent, or Firm* — Haynes and Boone, LLP

(57) ABSTRACT

A gravel packing apparatus has first and second joints each including a sand control screen assembly having a filter medium positioned exteriorly of a base pipe and a slurry delivery subassembly positioned exteriorly of the sand control screen assembly. Each slurry delivery subassembly includes a transport tube extending longitudinally along at least a portion of the sand control screen assembly. A jumper tube extends between and is sealably coupled to the transport tube of the first joint and the transport tube of the second joint. A first locking assembly is positioned between the jumper tube and the transport tube of the first joint and a second locking assembly is positioned between the jumper tube and the transport tube of the second joint.

20 Claims, 7 Drawing Sheets

(56) References Cited

U.S. PATENT DOCUMENTS

| | | | | |
|---|---|---|---|---|
| 2008/0066900 | A1 | 3/2008 | Saebi et al. | |
| 2008/0190608 | A1 | 8/2008 | Coronado et al. | |
| 2009/0008084 | A1 | 1/2009 | Dybevik et al. | |
| 2009/0159270 | A1 | 6/2009 | Setterberg et al. | |
| 2009/0294128 | A1 | 12/2009 | Dale et al. | |
| 2013/0248179 | A1* | 9/2013 | Yeh | E21B 23/06 166/278 |

OTHER PUBLICATIONS

Patent Examination Report No. 1 issued by the Australian Government, IP Australia, regarding Australian patent application No. 2012396247, dated Dec. 1, 2015, 3 pages.

First Written Opinion issued by the Intellectual Property Office of Singapore, regarding Singapore patent application No. 11201503116Q, dated Feb. 16, 2016, 5 pages.

* cited by examiner

GRAVEL PACKING APPARATUS HAVING LOCKING JUMPER TUBES

CROSS-REFERENCE TO RELATED APPLICATIONS

This application claims the benefit under 35 U.S.C. §119 of the filing date of International Application No. PCT/US2012/068524, filed Dec. 7, 2012.

TECHNICAL FIELD OF THE INVENTION

This invention relates, in general, to equipment utilized in conjunction with operations performed in relation to subterranean wells and, in particular, to a gravel packing apparatus having locking jumper tubes and a method for assembling the gravel packing apparatus on the rig floor.

BACKGROUND OF THE INVENTION

Without limiting the scope of the present invention, its background is described with reference to a sand control completion in a wellbore traversing an unconsolidated or loosely consolidated subterranean formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate may cause abrasive wear to components within the well. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use tubing positioned exteriorly along the length of the sand control screens to provide an alternate path for the fluid slurry around the sand bridge. It has been found, however, that it is difficult and time consuming to establish fluid communication between the alternate path components of adjacent sand control screens on the rig floor prior to installation into the wellbore. Therefore, a need has arisen for an apparatus for gravel packing a production interval that overcomes the problems associated with sand bridges. A need has also arisen for such an apparatus wherein fluid communication between the alternate path components of adjacent sand control screens is easy to establish on the rig floor.

SUMMARY OF THE INVENTION

The present invention disclosed herein is directed to a gravel packing apparatus having locking jumper tubes. The gravel packing apparatus of the present invention is operable to overcome the problems associated with sand bridges. In addition, the gravel packing apparatus of the present invention enables fluid communication between the alternate path components of adjacent sand control screens to be easily established on the rig floor.

In one aspect, the present invention is directed to a gravel packing apparatus. The gravel packing apparatus includes first and second joints each including a sand control screen assembly having a filter medium positioned exteriorly of a base pipe and a slurry delivery subassembly positioned exteriorly of the sand control screen assembly. Each slurry delivery subassembly includes at least one transport tube extending longitudinally along at least a portion of the sand control screen assembly. At least one jumper tube extends between and is sealably coupled to the at least one transport tube of the first joint and the at least one transport tube of the second joint. A first locking assembly is positioned between the at least one jumper tube and the at least one transport tube of the first joint and a second locking assembly is positioned between the at least one jumper tube and the at least one transport tube of the second joint.

In one embodiment, a first component of the first locking assembly is supported by the transport tube of the first joint and a second component of the first locking assembly is supported by the jumper tube. Likewise, a first component of the second locking assembly is supported by the transport tube of the second joint and a second component of the second locking assembly is supported by the jumper tube. In this embodiment, the first component of the first and second locking assemblies may be a groove and the second component of the first and second locking assemblies may be a collet assembly, a locking ring or the like. In one configuration, the second component of the first and second locking assemblies is operably positionable to the exterior of the first component of the first and second locking assemblies, respectively. In another configuration, the second component of the first and second locking assemblies is operably positionable to the interior of the first component of the first and second locking assemblies, respectively.

In another aspect, the present invention is directed to a gravel packing apparatus. The gravel packing apparatus includes a first joint including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly, the transport tube including a first component of a first locking assembly. The gravel packing apparatus also includes a second joint including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly, the transport tube including a first component of a second locking assembly. At least one jumper tube is operable to be sealably coupled between the at least one transport tube of the first joint and the at least one transport tube of the second joint. The jumper tube includes a second component of the first locking assembly at a first end and a second component of the second locking assembly at a second end such that axial engagement of the at least one jumper tube with the transport tube of the first joint operatively engages the first and second components of the first locking assembly and axial engagement of the at least one jumper tube with the transport tube of the second joint operatively engages the first and second components of the second locking assembly.

In a further aspect, the present invention is directed to a method for assembling a gravel packing apparatus. The method includes providing first and second joints each including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly; threadably coupling the first and second joints together; axially engaging a first end of a jumper tube with the transport tube of the first joint to establish a sealing and locking relationship therebetween; telescopically extending the jumper tube; and axially engaging a second end of the jumper tube with the transport tube of the second joint to establish a sealing and locking relationship therebetween.

The method may also include engaging a first component of a first locking assembly supported by the transport tube of the first joint with a second component of the first locking assembly supported by the jumper tube and engaging a first component of a second locking assembly supported by the transport tube of the second joint with a second component of the second locking assembly supported by the jumper tube; engaging a first collet assembly with a first groove and engaging a second collet assembly with a second groove; engaging a first locking ring with a first groove and engaging a second locking ring with a second groove; disposing the first end of the jumper tube to the interior of the transport tube of the first joint and disposing the second end of the jumper tube to the interior of the transport tube of the second joint and/or positioning at least a portion of the first end of the jumper tube to the exterior of the transport tube of the first joint and positioning at least a portion of the second end of the jumper tube to the exterior of the transport tube of the second joint.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
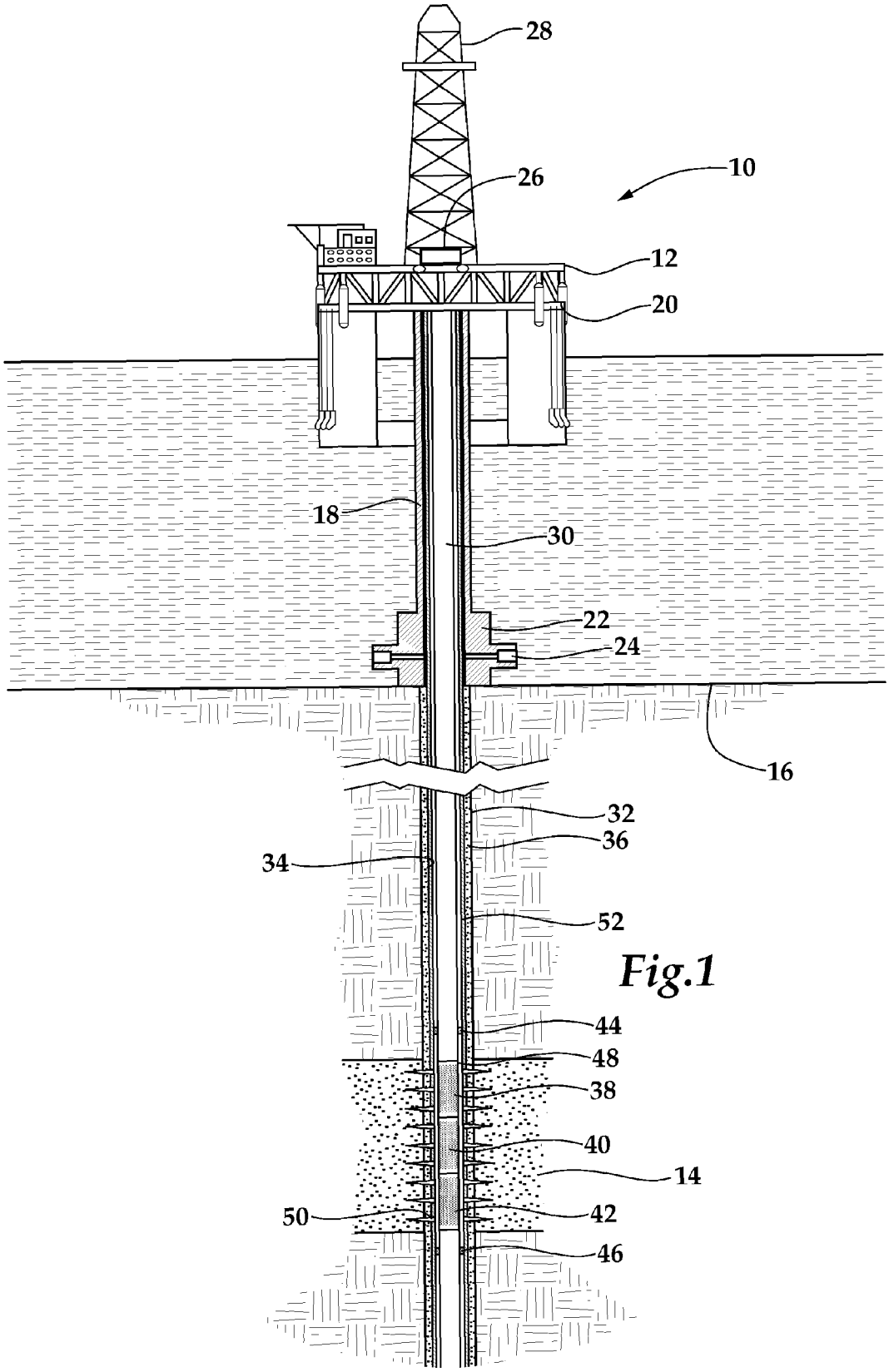
FIG. 1 is a schematic illustration of an offshore platform operating a gravel packing apparatus having locking jumper tubes according to an embodiment of the present invention.

Referring initially to FIG. 1, a gravel packing apparatus positioned in an interval of a wellbore and operating from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is secured within wellbore 32 by cement 36. Work string 30 includes various tools including joints 38, 40, 42 that form the gravel packing apparatus of the present invention that is positioned in an interval of wellbore 32 adjacent to formation 14 between packers 44, 46. When it is desired to gravel pack annular region 48 surrounding joints 38, 40, 42, a fluid slurry including a liquid carrier and a particulate material such as sand, gravel or proppants is pumped down work string 30.

Some or all of the fluid slurry is typically injected directly into annular region 48 in a known manner, such as through a crossover tool (not pictured), which allows the slurry to travel from the interior of work string 30 to the exterior of work string 30. Once the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of joints 38, 40, 42 filling those sections with gravel. The sand control screens within joints 38, 40, 42 disallows further migration of the gravel but allows the liquid carrier to travel therethrough into work string 30 and up to the surface via annulus 52. If sand bridges form in annular region 48, some or all of the fluid slurry is injected or diverted into the slurry delivery subassemblies within and connected between joints 38, 40, 42 to bypass the sand bridges such that a complete pack can be achieved.

Even though FIG. 1 depicts the gravel packing apparatus of the present invention in a vertical wellbore, it should be understood by those skilled in the art that the gravel packing apparatus of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be noted by one skilled in the art that the gravel packing apparatus of the present invention is equally well suited for use in onshore operations. Further, even though FIG. 1 depicts the gravel packing apparatus of the present invention as having a particular number of joints, it should be understood by those skilled in the art that a gravel packing apparatus of the present invention may have any number of joints both less than or greater than the number shown.

Figure 2:
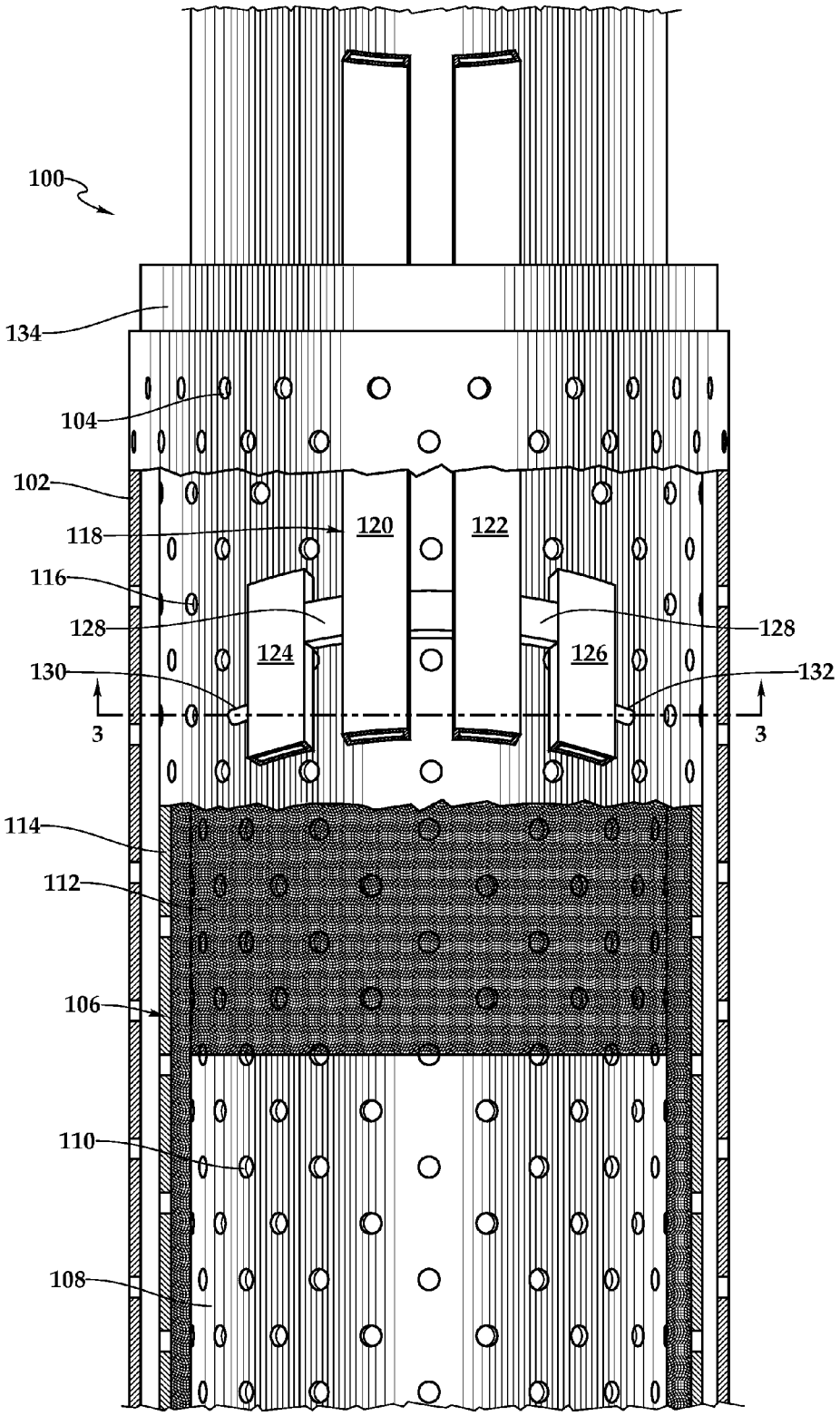
FIG. 2 is a side view partially in cut away of a gravel packing apparatus having locking jumper tubes according to an embodiment of the present invention.

Referring next to FIG. 2, therein is depicted a cut away view of a gravel packing apparatus of the present invention that is generally designated 100. Apparatus 100 has an outer tubular or shroud 102 that includes a plurality of openings 104 that are substantially evenly distributed around and along the length of outer tubular 102, which allow the flow of production fluids therethrough. Disposed within outer tubular 102 is a sand control screen assembly 106. Sand control screen assembly 106 includes a base pipe 108 that has a plurality of openings 110 which allow the flow of production fluids into the production tubing. The exact number, size and shape of openings 110 are not critical to the present invention, so long as sufficient area is provided for fluid production and the integrity of base pipe 108 is maintained.

Positioned around base pipe 108 is a filter medium depicted as a fluid-porous, particulate restricting wire mesh screen 112. Screen 112 is designed to allow fluid flow therethrough but prevent the flow of particulate materials of a predetermined size from passing therethrough. Screen 112 preferably has a plurality of layers of wire mesh including one or more drainage layers and one or more filter layers wherein the drainage layers that have a mesh size that is larger than the mesh size of the filter layers. For example, a drainage layer may preferably be positioned as the outermost layer and the innermost layer of wire mesh screen 112 with the filter layer or layers positioned therebetween. Positioned around screen 112 is a screen wrapper 114 that has a plurality of openings 116 which allow the flow of production fluids therethrough. The exact number, size and shape of openings 116 is not critical to the present invention, so long as sufficient area is provided for fluid production and the integrity of screen wrapper 114 is maintained. Typically, various sections of screen 112 and screen wrapper 114 are manufactured together as a unit by, for example, diffusion bonding or sintering the layers of wire mesh that form screen 112 together with screen wrapper 114, then rolling the unit into a tubular configuration. The two ends of the tubular unit are then seam welded together. Several tubular units of the screen and screen wrapper combination may be placed over each joint of base pipe 108 and secured thereto by welding or other suitable technique. It should be understood by those skilled in the art that even though FIG. 2 has described a particular filter medium, other types of filter media could alternatively be used in conjunction with the apparatus of the present invention, including, but not limited to, a wire wrapped sand control screen.

Disposed between outer tubular 102 and sand control screen assembly 106 is a slurry delivery subassembly 118. In the illustrated embodiment, slurry delivery subassembly 118 includes a pair of transport tubes 120, 122, a pair of packing tubes 124, 126 and a manifold 128 that provides fluid communication between transport tubes 120, 122 and packing tubes 124, 126. As illustrated, transport tubes 120, 122 extend longitudinally past outer tubular 102 such that the transport tubes 120, 122 of one joint can be fluidically coupled to the transport tubes 120, 122 of another joint as explained in greater detail below. Packing tubes 124, 126 each include a plurality of nozzles, such as nozzle 130 of packing tube 124 and nozzle 132 of packing tube 126. In the event of sand bridge formation or as part of a planned gravel packing process, some or all of the fluid slurry is injected into the slurry delivery subassembly 118 of the uppermost joint. The fluid slurry is able to travel from one joint to the next via the transport tubes 120, 122 and jumper tubes that are sealingly and lockably positioned therebetween, as explained in greater detail below. As the fluid slurry travels from joint to joint, portions of the fluid slurry enter packing tubes 124, 126 via manifold 128. From packing tubes 124, 126, the fluid slurry is able to enter the annular region surrounding gravel packing apparatus 100 by exiting slurry delivery subassembly 118 via nozzles 130, 132. In this manner, a complete gravel pack may be achieved even if sand bridges form in the annular region surrounding gravel packing apparatus 100.

In the illustrated embodiment, transport tubes 120, 122 extend through a ring assembly 134 that is preferably welded to base pipe 108. Likewise, outer tubular 102 may be welded to ring assembly 134. Ring assembly 134 may be eccentric in design such that it has suitable thickness to receive and support transport tubes 120, 122 on one side but may be thinner on the opposite side. Ring assembly 134 may be a single solid ring or may be formed from ring sections that substantially form a solid ring or may form a circumferentially segmented ring having gaps between the ring sections. Ring assembly 134 may include multiple components that receive and support transport tubes 120, 122 and may have notches, slots or openings that receive and support transport tubes 120, 122.

Figure 3:
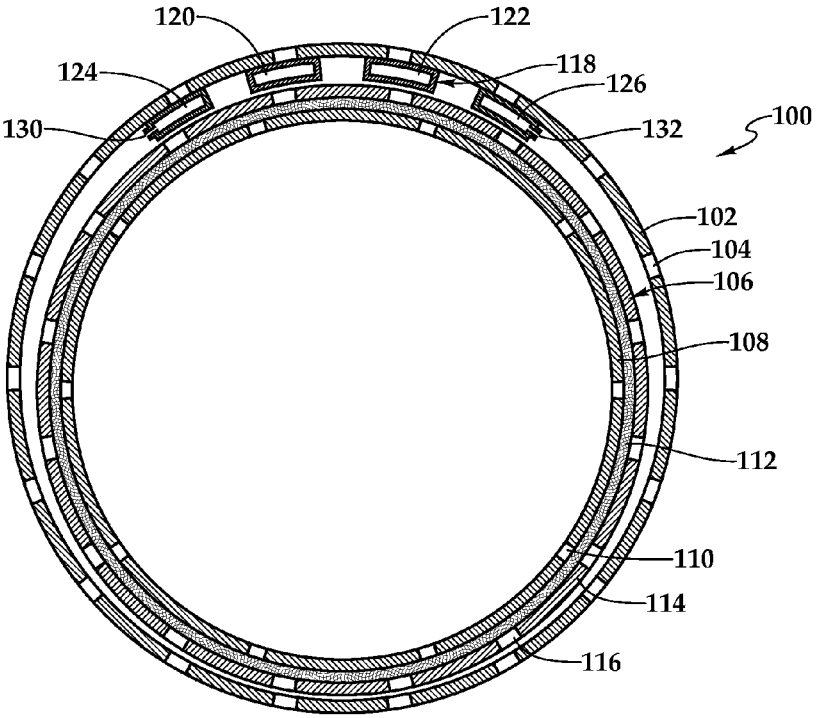
FIG. 3 is a cross sectional view of a gravel packing apparatus having locking jumper tubes according to an embodiment of the present invention.
Figure 4:
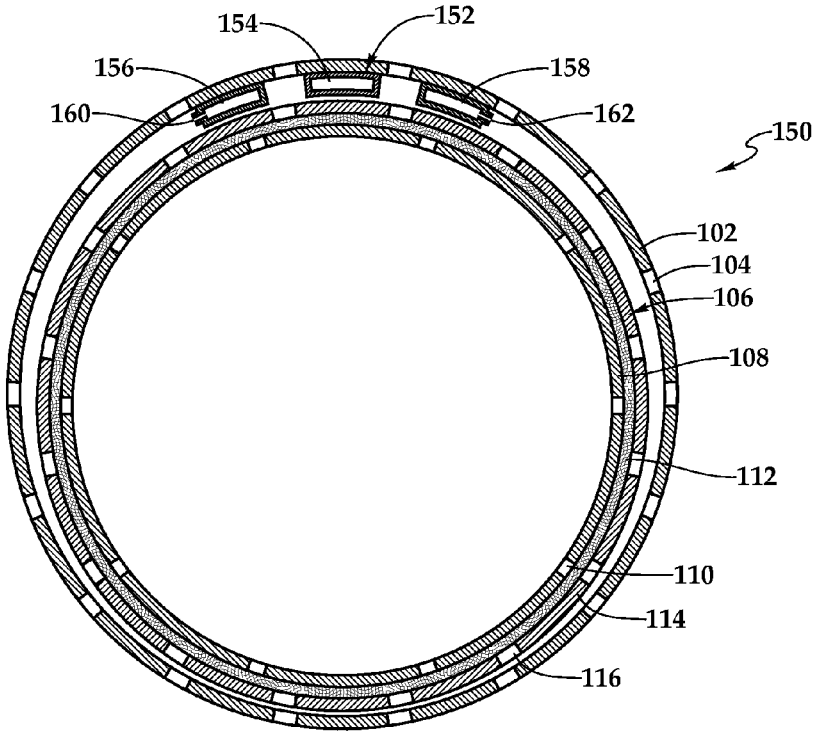
FIG. 4 is a cross sectional view of a gravel packing apparatus having locking jumper tubes according to an embodiment of the present invention.
Figure 5:
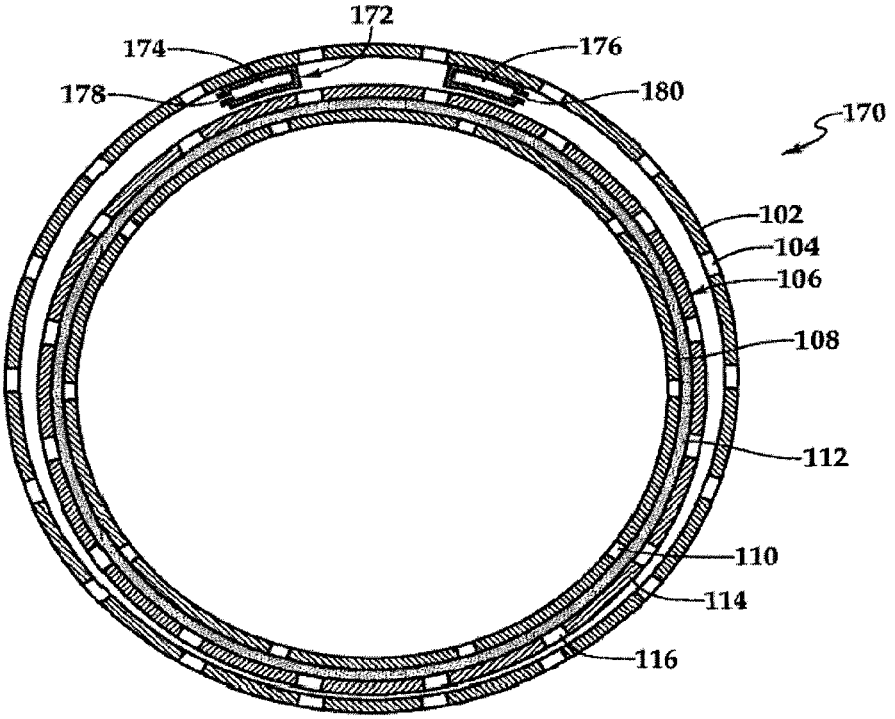
FIG. 5 is a cross sectional view of a gravel packing apparatus having locking jumper tubes according to an embodiment of the present invention.
Figure 6:
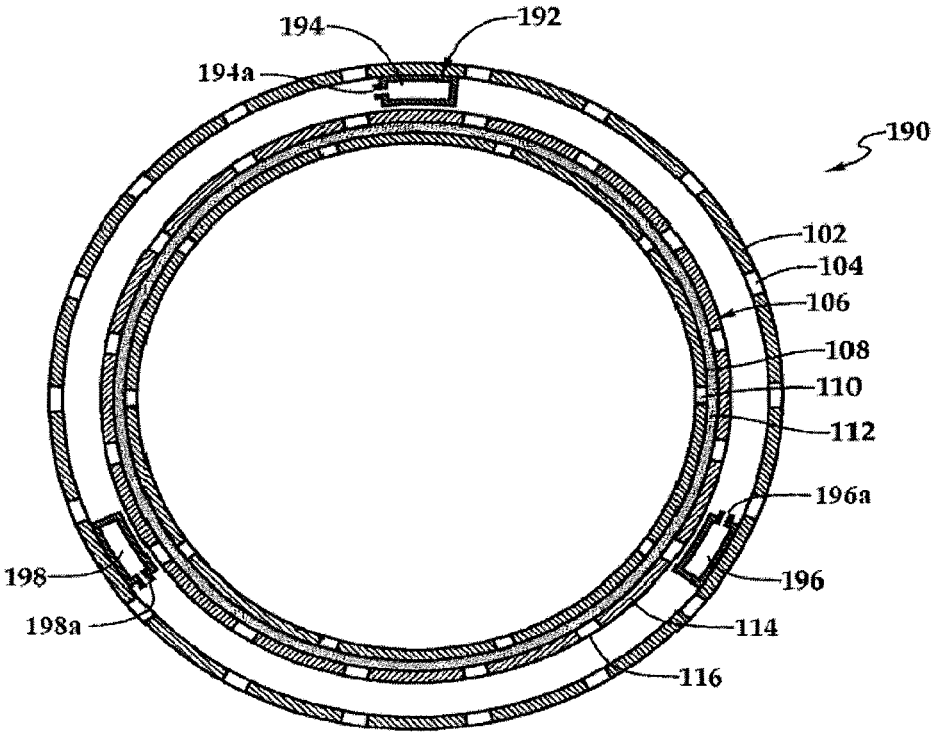
FIG. 6 is a cross sectional view of a gravel packing apparatus having locking jumper tubes according to an embodiment of the present invention.

As best seen in FIG. 3, sand control screen assembly 106 may be eccentrically positioned within outer tubular 102 to enable slurry delivery subassembly 118 to be positioned therebetween while maintaining a desired outer diameter of gravel packing apparatus 100. It should be understood by those skilled in the art, however, that even though FIGS. 2 and 3 have described a particular slurry delivery subassembly, other slurry delivery subassembly having other configurations could alternatively be used in conjunction with the apparatus of the present invention. For example, as best seen in FIG. 4, a gravel packing apparatus 150 is depicted having a slurry delivery subassembly 152 including a single transport tube 154 and a pair of packing tubes 156, 158 each having a plurality of nozzles 160, 162 in an eccentric design. In another example, as best seen in FIG. 5, a gravel packing apparatus 170 is depicted having a slurry delivery subassembly 172 including a pair of slurry delivery tubes 174, 176 that serve as both transport tubes, as they extend from joint to joint, as well as packing tubes, as each has a plurality of nozzles 178, 180. Gravel packing apparatus 170 also has an eccentric design. In a further example, as best seen in FIG. 6, a gravel packing apparatus 190 is depicted having a slurry delivery subassembly 192 including three slurry delivery tubes 194, 196, 198 that serve as both transport tubes, as they extend from joint to joint, as well as packing tubes, as each has a plurality of nozzles 194*a*, 196*a*, 198*a*. Unlike the previously described gravel packing apparatuses, gravel packing apparatus 190 has a concentric design wherein sand control screen assembly 106 is concentrically positioned within the outer tubular 102 with slurry delivery tubes 194, 196, 198 circumferentially distributed therebetween.

Figure 7A:
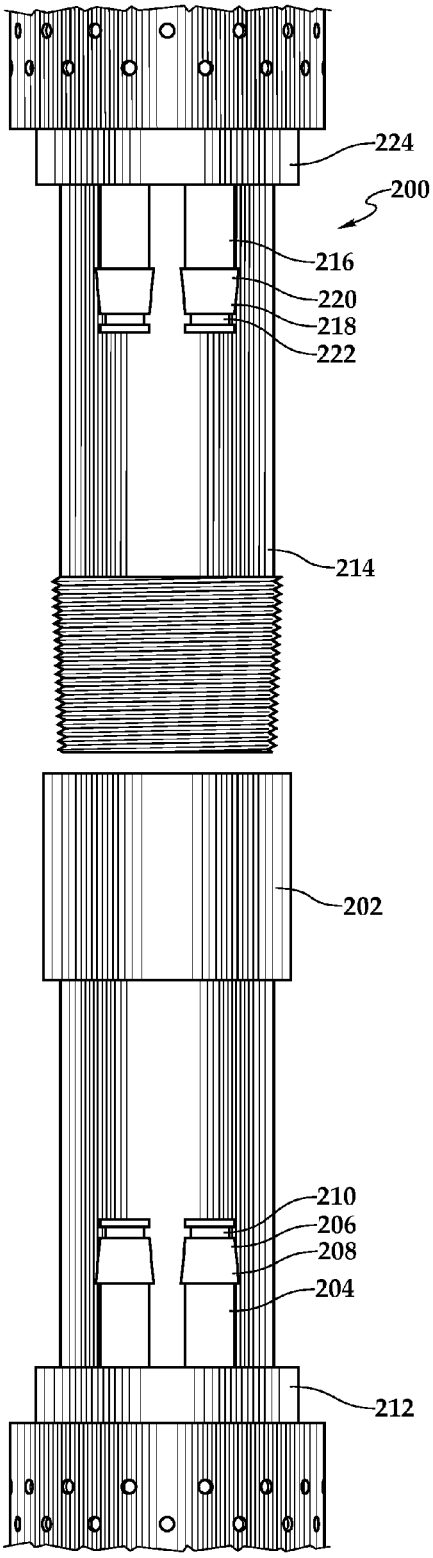
FIGS. 7A-7D are schematic illustration of the process of coupling two joints of a gravel packing apparatus having locking jumper tubes according to an embodiment of the present invention.
Figure 7B:
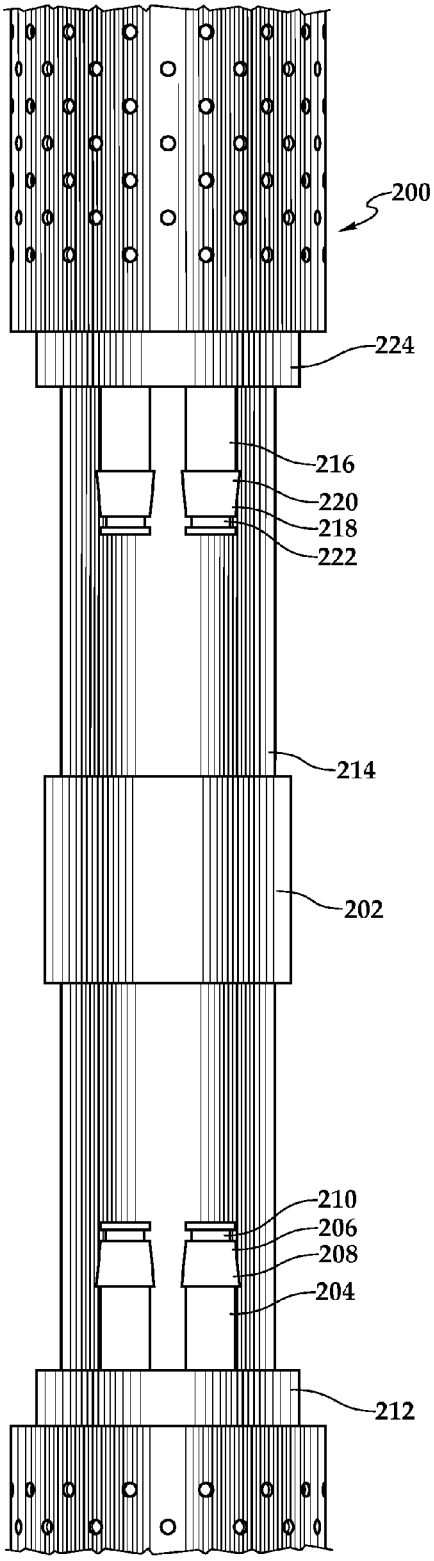

The operation of the assembling a gravel packing apparatus 200 of the present invention will now be described with reference to FIGS. 7A-7D. A lower joint of gravel packing apparatus 200 is depicted as joint 202 having a pair of transport tubes 204 each including a first component of a locking assembly depicted a transition assembly 206, as best seen in FIG. 7A. In the illustrated embodiment, each transition assembly 206 has a transition section 208 that couples to the rectangular transport tube 204 on one end and has an oppositely disposed circular receiving end including locking groove 210. Each transition assembly 206 is supported by one transport tube 204 and may be secured thereto by welding, set screws or other suitable technique. Transport tubes 204 are supported by a ring assembly 212. Joint 202 is supported by the well platform in, for example, a screen table assembly attached to the rotary table generally located on the well floor of the platform (not pictured). An upper joint of gravel packing apparatus 200 is depicted as joint 214 having a pair of transport tubes 216 each including a first component of a locking assembly depicted a transition assembly 218. In the illustrated embodiment, each transition assembly 218 has a transition section 220 that couples to the rectangular transport tube 216 on one end and has an oppositely disposed circular receiving end including locking groove 222. Each transition assembly 218 is supported by one transport tube 216 and may be secured thereto by welding, set screws or other suitable technique. Transport tubes 216 are supported by a ring assembly 224. Upper joint 214 has been maneuvered into position above lower joint 202 using the hoisting apparatus of the well platform (not pictured). Joints 202 and 214 may now be threadably connected to one another, as best seen in FIG. 7B, and may be supported by the hoisting apparatus of the well platform (not pictured).

Figure 7C:
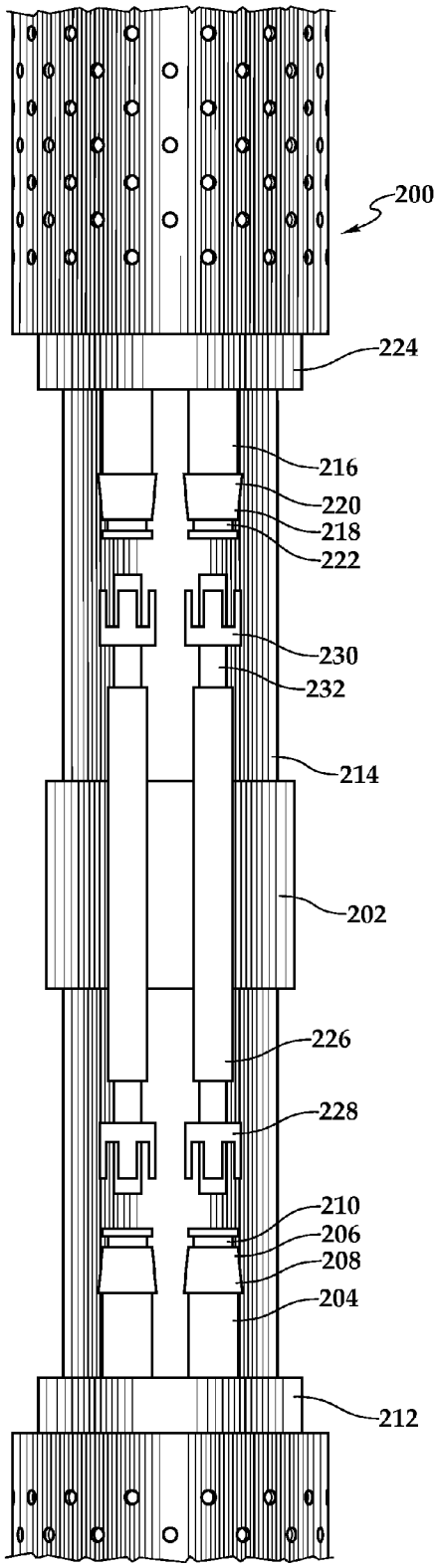
Figure 7D:
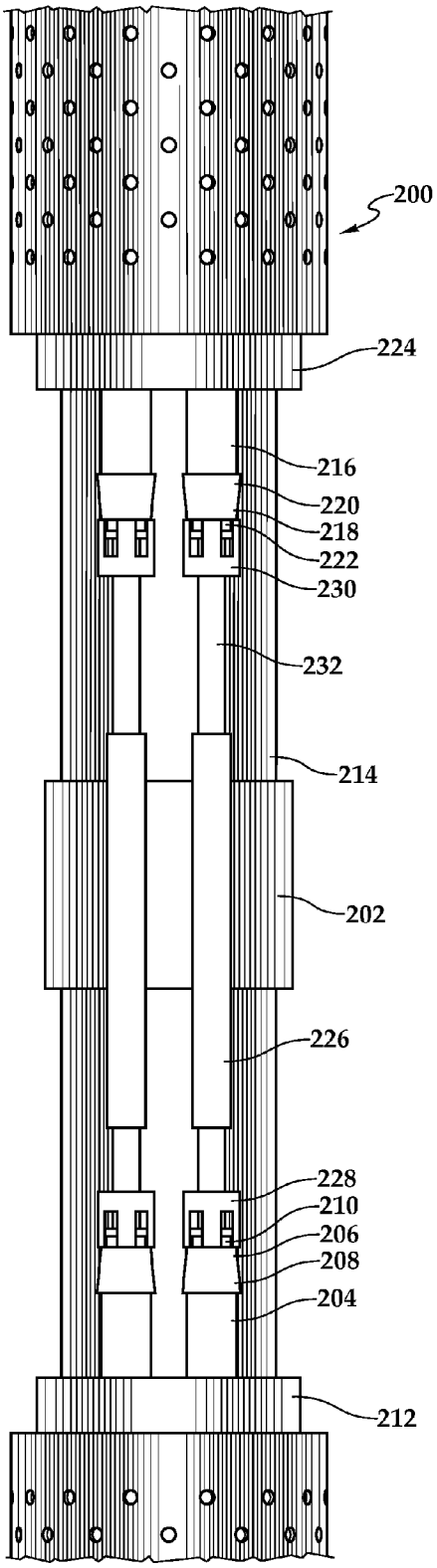

Once in this position, jumper tubes 226 may be coupled between transport tubes 204 of joint 202 and transport tubes 216 of joint 214, which establish fluid communication therebetween and preferably a fluid tight seal therebetween. As best seen in FIG. 7C, each jumper tube 226 includes the second components of the locking assemblies depicted as collet assemblies 228, 230. To operatively engage jumper tubes 226 with transport tubes 204, 216, each jumper tube 226 is axially shifted downwardly inserting the lower end of jumper tube 226 within a transition assembly 208. A relative axial force is then applied between each jumper tube 226 and transport tube 204 such that the collet fingers of each collet assembly 228 snaps into engagement with a locking groove 210 of a transition assembly 208. In this configuration, a sealing and locking relationship has been established between jumper tubes 226 and transport tubes 204. Inner tubes 232 of jumper tubes 226 may now be telescopically extended upwardly in the axial direction enabling insertion of the upper end of each jumper tube 226 within a transition assembly 218. A relative axial force is then applied between each jumper tube 226 and transport tube 216 such that the collet fingers of each collet assembly 230 snap into engagement with a locking groove 222 of a transition assembly 218. In this configuration, a sealing and locking relationship has been established between jumper tubes 226 and transport tubes 216, as best seen in FIG. 7D.

Figure 8A:
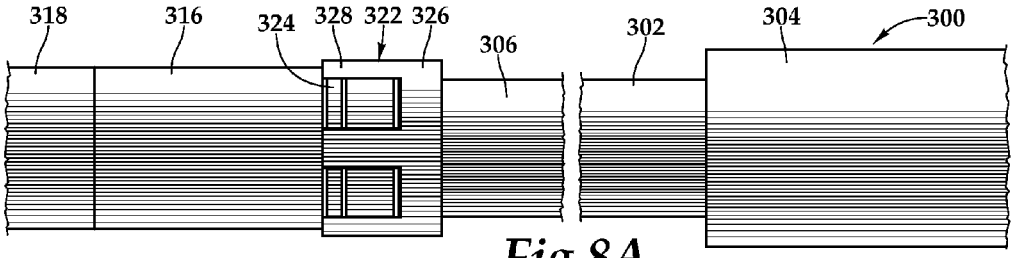
FIGS. 8A-8B are side and cross sectional views of a locking jumper tube for use in a gravel packing apparatus according to an embodiment of the present invention.
Figure 8B:
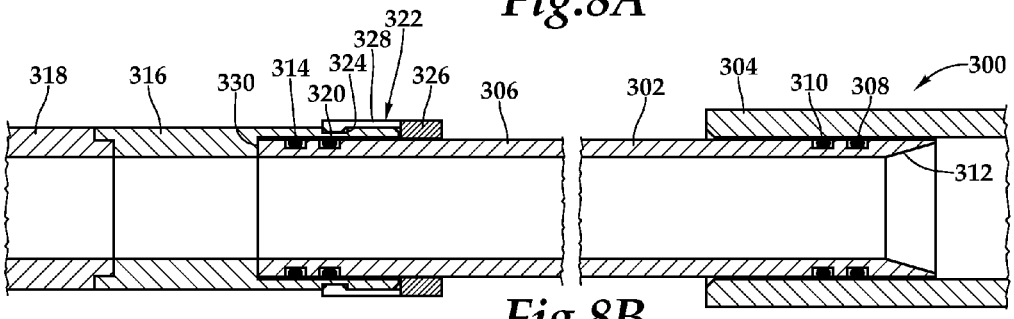

Referring next to FIGS. 8A-8B, therein are depicted a portion of a gravel packing apparatus having locking jumper tubes according to the present invention that is generally designated 300. In the illustrated embodiment, a jumper tube 302 includes a first tubular member 304 and a second tubular member 306 that slidingly engages within first tubular member 304. Second tubular member 306 is configured to axially slidingly displace from at least one distal end of first tubular member 304 to telescopically extend the length of the jumper tube 302 so that jumper tube 302 may couple with transport tubes of adjacent joints as described above. The sliding relationship between first tubular member 304 and second tubular member 306 is such that the inside diameter of first tubular member 304 and the outside diameter of second tubular member 306 are substantially similar and configured to allow second tubular member 306 to be disposed within first tubular member 304.

A seal 308 between first tubular member 304 and second tubular member 306 may be used to create a sealing engagement therebetween preventing fluid from passing into or out of jumper tube 302 at the location where first tubular member 304 and second tubular member 306 meet while still allowing for axial movement therebetween. In addition, an optional back-up seal 310 may be disposed between first tubular member 304 and second tubular member 306 to provide a second sealing engagement between first tubular member 304 and second tubular member 306. A fluid flow transition 312 is disposed within second tubular member 306 so that the inside diameter of at least a portion of second tubular member 306 is axially tapered. Fluid flow transition 312 is configured to transition fluid flow axially through jumper tube 302 at the location where second tubular member 306 and first tubular member 304 meet. At the opposite end, second tubular member 306 includes a seal 314 that is operable to create a sealing engagement between second tubular member 306 and an interior surface of a transition assembly 316 that is coupled to a transport tube 318 at its opposite end. In addition, an optional back-up seal 320 may be disposed between second tubular member 306 and transition assembly 316 to provide a second sealing engagement therebetween.

In the illustrated embodiment, a locking assembly 322 includes a first component supported by transport tube 318 and transition assembly 316 depicted as locking groove 324 and a second component supported by jumper tube 302 depicted as collet assembly 326 including a plurality of collet fingers 328. As described above, to operatively engage jumper tube 302 with transport tube 318, jumper tube 302 is axially shifted to insert the distal end of second tubular member 306 within transition assembly 316. A relative axial force is then applied between jumper tube 302 and transport tube 318 such that collet fingers 328 flex radially outwardly to pass over the end of transition assembly 316. Further axial shifting of second tubular member 306 relative to transition assembly 316 enables collet fingers 328 to snap radially inwardly into engagement with locking groove 324 of transition assembly 316. Preferably, the distal end of second tubular member 306 also contacts a shoulder 330 of transition assembly 316. In this configuration, a sealing and locking relationship has been established between jumper tube 302 and transport tube 318. In this manner, jumper tubes 302 can be quickly and easily installed between transport tubes of adjacent gravel packing joints to enable fluid communication therebetween and prevent disconnection thereof.

Figure 9:
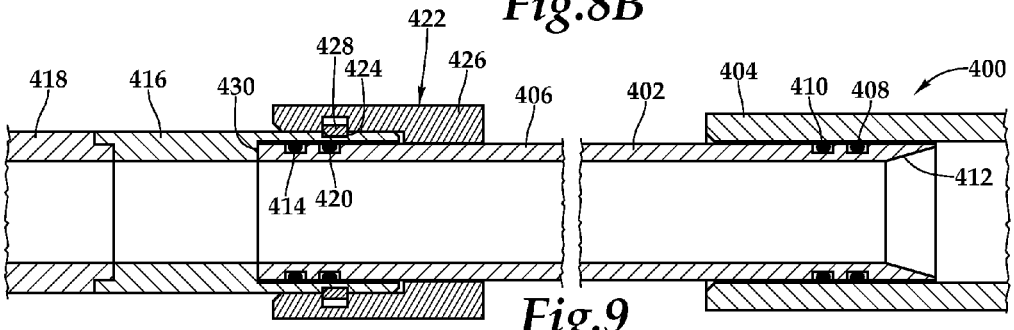
FIG. 9 is a cross sectional view of a locking jumper tube for use in a gravel packing apparatus according to an embodiment of the present invention.

Referring next to FIG. 9, therein is depicted a portion of a gravel packing apparatus having locking jumper tubes according to the present invention that is generally designated 400. In the illustrated embodiment, a jumper tube 402 includes a first tubular member 404 and a second tubular member 406 that slidingly engages within first tubular member 404. Second tubular member 406 is configured to telescopically extend the length of jumper tube 402 so that jumper tube 402 may couple with transport tubes of adjacent joints as described above. The sliding relationship between first tubular member 404 and second tubular member 406 is such that the inside diameter of first tubular member 404 and the outside diameter of second tubular member 406 are substantially similar and configured to allow second tubular member 406 to be disposed within first tubular member 404.

A seal 408 between first tubular member 404 and second tubular member 406 may be used to create a sealing engagement therebetween preventing fluid from passing into or out of jumper tube 402 at the location where first tubular member 404 and second tubular member 406 meet while still allowing for axial movement of therebetween. In addition, an optional back-up seal 410 may be disposed between first tubular member 404 and second tubular member 406 to provide a second sealing engagement between first tubular member 404 and second tubular member 406. A fluid flow transition 412 is disposed within second tubular member 406 so that the inside diameter of at least a portion of second tubular member 406 is axially tapered. Fluid flow transition 412 is configured to transition fluid flow axially through jumper tube 402 at the location where second tubular member 406 and first tubular member 404 meet. At the opposite end, second tubular member 406 includes a seal 414 that is operable to create a sealing engagement between second tubular member 406 and an interior surface of a transition assembly 416 that is coupled to a transport tube 418 at its opposite end. In addition, an optional back-up seal 420 may be disposed between second tubular member 406 and transition assembly 416 to provide a second sealing engagement therebetween.

In the illustrated embodiment, a locking assembly 422 includes a first component supported by transport tube 418 and transition assembly 416 depicted as locking groove 424 and a second component supported by jumper tube 402 depicted as a locking housing 426 and a locking ring 428, which is preferably a split ring or c-ring sized to be received within locking groove 424 and prevent relative axial movement between jumper tube 402 and transport tube 418 once received therein. As described above, to operatively engage jumper tube 402 with transport tube 418, jumper tube 402 is axially shifted to insert the distal end of second tubular member 406 within transition assembly 416. A relative axial force is then applied between jumper tube 402 and transport tube 418 such that locking ring 428 flexes radially outwardly within housing 426 to pass over the end of transition assembly 416. Further axial shifting of second tubular member 406 relative to transition assembly 416 enables locking ring 428 to snap radially inwardly into engagement with locking groove 424 of transition assembly 416. Preferably, the distal end of second tubular member 406 also contacts a shoulder 430 of transition assembly 416. In this configuration, a sealing and locking relationship has been established between jumper tube 402 and transport tube 418. In this manner, jumper tubes 402 can be quickly and easily installed between transport tubes of adjacent gravel packing joints to enable fluid communication therebetween and prevent disconnection thereof.

Figure 10:
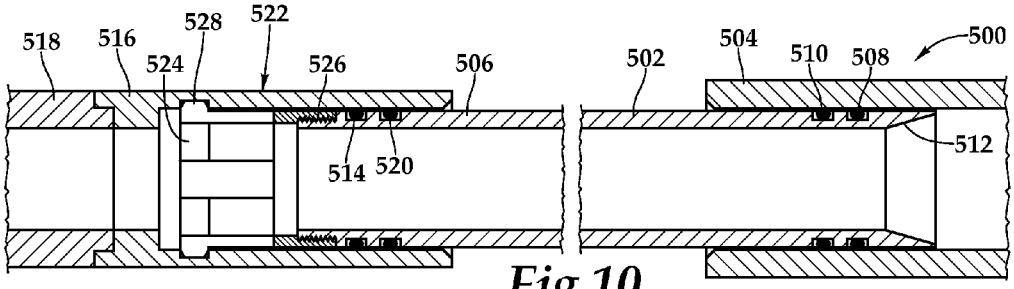
FIG. 10 is a cross sectional view of a locking jumper tube for use in a gravel packing apparatus according to an embodiment of the present invention.

Referring next to FIG. 10, therein is depicted a portion of a gravel packing apparatus having locking jumper tubes according to the present invention that is generally designated 500. In the illustrated embodiment, a jumper tube 502 includes a first tubular member 504 and a second tubular member 506 that slidingly engages within first tubular member 504. Second tubular member 506 is configured to telescopically extend the length of jumper tube 502 so that jumper tube 502 may couple with transport tubes of adjacent joints as described above. The sliding relationship between first tubular member 504 and second tubular member 506 is such that the inside diameter of first tubular member 504 and the outside diameter of second tubular member 506 are substantially similar and configured to allow second tubular member 506 to be disposed within first tubular member 504.

A seal 508 between first tubular member 504 and second tubular member 506 may be used to create a sealing engagement therebetween preventing fluid from passing into or out of jumper tube 502 at the location where first tubular member 504 and second tubular member 506 meet while still allowing for axial movement of therebetween. In addition, an optional back-up seal 510 may be disposed between first tubular member 504 and second tubular member 506 to provide a second sealing engagement between first tubular member 504 and second tubular member 506. A fluid flow transition 512 is disposed within second tubular member 506 so that the inside diameter of at least a portion of second tubular member 506 is axially tapered. Fluid flow transition 512 is configured to transition fluid flow axially through jumper tube 502 at the location where second tubular member 506 and first tubular member 504 meet. At the opposite end, second tubular member 506 includes a seal 514 that is operable to create a sealing engagement between second tubular member 506 and an interior surface of a transition assembly 516 that is coupled to a transport tube 518 at its opposite end. In addition, an optional back-up seal 520 may be disposed between second tubular member 506 and transition assembly 516 to provide a second sealing engagement therebetween.

In the illustrated embodiment, a locking assembly 522 includes a first component supported by transport tube 518 and transition assembly 516 depicted as locking groove 524 and a second component supported by jumper tube 502 depicted as collet assembly 526 including a plurality of collet fingers 528. To operatively engage jumper tube 502 with transport tube 518, jumper tube 502 is axially shifted to align the distal end of second tubular member 506 with transition assembly 516. A relative axial force is then applied between jumper tube 502 and transport tube 518 such that collet fingers 528 flex radially inwardly into the end of transition assembly 516. Further axial shifting of second tubular member 506 relative to transition assembly 516 enables collet fingers 528 to snap radially outwardly into engagement with locking groove 524 of transition assembly 516. In this configuration, a sealing and locking relationship has been established between jumper tube 502 and transport tube 518. In this manner, jumper tubes 502 can be quickly and easily installed between transport tubes of adjacent gravel packing joints to enable fluid communication therebetween and prevent disconnection thereof.

Figure 11:
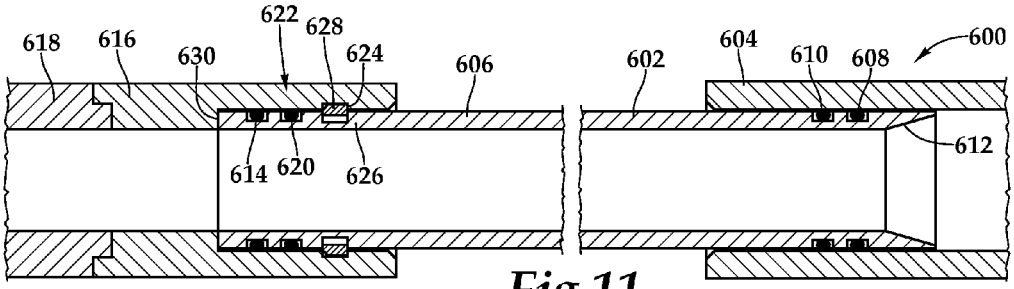
FIG. 11 is a cross sectional view of a locking jumper tube for use in a gravel packing apparatus according to an embodiment of the present invention.

Referring next to FIG. 11, therein is depicted a portion of a gravel packing apparatus having locking jumper tubes according to the present invention that is generally designated 600. In the illustrated embodiment, a jumper tube 602 includes a first tubular member 604 and a second tubular member 606 that slidingly engages within first tubular member 604. Second tubular member 606 is configured to telescopically extend the length of jumper tube 602 so that jumper tube 602 may couple with transport tubes of adjacent joints as described above. The sliding relationship between first tubular member 604 and second tubular member 606 is such that the inside diameter of first tubular member 604 and the outside diameter of second tubular member 606 are substantially similar and configured to allow second tubular member 606 to be disposed within first tubular member 604.

A seal 608 between first tubular member 604 and second tubular member 606 may be used to create a sealing engagement therebetween preventing fluid from passing into or out of jumper tube 602 at the location where first tubular member 604 and second tubular member 606 meet while still allowing for axial movement of therebetween. In addition, an optional back-up seal 610 may be disposed between first tubular member 604 and second tubular member 606 to provide a second sealing engagement between first tubular member 604 and second tubular member 606. A fluid flow transition 612 is disposed within second tubular member 606 so that the inside diameter of at least a portion of second tubular member 606 is axially tapered. Fluid flow transition 612 is configured to transition fluid flow axially through jumper tube 602 at the location where second tubular member 606 and first tubular member 604 meet. At the opposite end, second tubular member 606 includes a seal 614 that is operable to create a sealing engagement between second tubular member 606 and an interior surface of a transition assembly 616 that is coupled to a transport tube 618 at its opposite end. In addition, an optional back-up seal 620 may be disposed between second tubular member 606 and transition assembly 616 to provide a second sealing engagement therebetween.

In the illustrated embodiment, a locking assembly 622 includes a first component supported by transport tube 618 and transition assembly 616 depicted as locking groove 624 and a second component supported by jumper tube 602 depicted as a locking housing 626 and a locking ring 628, which is preferably a split ring or c-ring sized to be received within locking groove 624 and prevent relative axial movement between jumper tube 602 and transport tube 618 once received therein. To operatively engage jumper tube 602 with transport tube 618, jumper tube 602 is axially shifted to insert the distal end of second tubular member 606 within transition assembly 616. A relative axial force is then applied between jumper tube 602 and transport tube 618 such that locking ring 628 flexes radially inwardly then enters transition assembly 616. Further axial shifting of second tubular member 606 relative to transition assembly 616 enables locking ring 628 to snap radially outwardly into engagement with locking groove 624 of transition assembly 616. Preferably, the distal end of second tubular member 606 also contacts a shoulder 630 of transition assembly 616. In this configuration, a sealing and locking relationship has been established between jumper tube 602 and transport tube 618. In this manner, jumper tubes 602 can be quickly and easily installed between transport tubes of adjacent gravel packing joints to enable fluid communication therebetween and prevent disconnection thereof.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A gravel packing apparatus comprising:

first and second joints each including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly;

at least one jumper tube extending between and sealably coupled to the at least one transport tube of the first joint and the at least one transport tube of the second joint, the at least one jumper tube comprising:

a first tubular member defining first and second ends;

a second tubular member configured to slidingly engage within the first tubular member to telescopically from the first end of the first tubular member; and a third tubular member configured to slidingly engage within the first tubular member to telescopically extend the length of the at least one jumper tube from the second end of the first tubular member;

a first locking assembly positioned between the second tubular member of the at least one jumper tube and the at least one transport tube of the first joint; and a second locking assembly positioned between the third tubular member of the at least one jumper tube and the at least one transport tube of the second joint.

2. The apparatus as recited in claim 1, wherein a first component of the first locking assembly is supported by the transport tube of the first joint and a second component of the first locking assembly is supported by the second tubular member of the at least one jumper tube; and wherein a first component of the second locking assembly is supported by the transport tube of the second joint and a second component of the second locking assembly is supported by the third tubular member of the at least one jumper tube.

3. The apparatus as recited in claim 2 wherein the first component of the first and second locking assemblies further comprises a groove.

4. The apparatus as recited in claim 2 wherein the second component of the first and second locking assemblies further comprises a collet assembly.

5. The apparatus as recited in claim 2 wherein the second component of the first and second locking assemblies further comprises a locking ring.

6. The apparatus as recited in claim 2 wherein the second component of the first and second locking assemblies is operably positionable to the exterior of the first component of the first and second locking assemblies, respectively.

7. The apparatus as recited in claim 2 wherein the second component of the first and second locking assemblies is operably positionable to the interior of the first component of the first and second locking assemblies, respectively.

8. A gravel packing apparatus comprising:

a first joint including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly, the transport tube including a first component of a first locking assembly;

a second joint including a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly, the transport tube including a first component of a second locking assembly;

at least one jumper tube operable to be sealably coupled between the at least one transport tube of the first joint and the at least one transport tube of the second joint, the at least one jumper tube comprising:

a first tubular member defining first and second ends;

a second tubular member configured to slidingly engage within the first tubular member to telescopically extend the length of the at least one jumper tube from the first end of the first tubular member, the second tubular member including a second component of the first locking assembly; and a third tubular member configured to slidingly engage within the first tubular member to telescopically extend the length of the at least one jumper tube from the second end of the first tubular member, the third tubular member including a second component of the second locking assembly;

wherein, axial engagement of the at least one jumper tube with the transport tube of the first joint operatively engages the first and second components of the first locking assembly; and wherein, axial engagement of the at least one jumper tube with the transport tube of the second joint operatively engages the first and second components of the second locking assembly.

9. The apparatus as recited in claim 8 wherein the first component of the first and second locking assemblies further comprises a groove.

10. The apparatus as recited in claim 8 wherein the second component of the first and second locking assemblies further comprises a collet assembly.

11. The apparatus as recited in claim 8 wherein the second component of the first and second locking assemblies further comprises a locking ring.

12. The apparatus as recited in claim 8 wherein the second component of the first and second locking assemblies is operably positionable to the exterior of the first component of the first and second locking assemblies, respectively.

13. The apparatus as recited in claim 8 wherein the second component of the first and second locking assemblies is operably positionable to the interior of the first component of the first and second locking assemblies, respectively.

14. The apparatus as recited in claim 8 wherein axial engagement of the at least one jumper tube with the transport tube of the second joint further comprises telescopically extending the at least one jumper tube.

15. A method for assembling a gravel packing apparatus, the method comprising:

providing first and second joints each comprising a sand control screen assembly having a filter medium positioned exteriorly of a base pipe and a slurry delivery subassembly positioned exteriorly of the sand control screen assembly, the slurry delivery subassembly including at least one transport tube extending longitudinally along at least a portion of the sand control screen assembly;

threadably coupling the respective base pipes of the first and second joints together;

providing at least one jumper tube to be sealably coupled between the at least one transport tube of the first joint and the at least one transport tube of the second joint, the at least one jumper tube comprising first, second, and third tubular members;

axially engaging the second tubular member of the at least one jumper tube with the transport tube of the first joint to establish a sealing and locking relationship therebetween;

slidingly engaging the second tubular member within the first tubular member to telescopically extend the length of the at least one jumper tube from a first end of the first tubular member;

slidingly engaging the third tubular member within the first tubular member to telescopically extend the length of the at least one jumper tube from a second end of the first tubular member; and axially engaging the third tubular member of the at least one jumper tube with the transport tube of the second joint to establish a sealing and locking relationship therebetween.

16. The method as recited in claim 15, wherein axially engaging the second tubular member of the at least one jumper tube with the transport tube of the first joint further comprises engaging a first component of a first locking assembly supported by the transport tube of the first joint with a second component of the first locking assembly supported by the second tubular member of the at least one jumper tube; and wherein axially engaging the third tubular member of the at least one jumper tube with the transport tube of the second joint further comprises engaging a first component of a second locking assembly supported by the transport tube of the second joint with a second component of the second locking assembly supported by the third tubular member of the at least one jumper tube.

17. The method as recited in claim 15, wherein axially engaging the second tubular member of the at least one jumper tube with the transport tube of the first joint further comprises engaging a first collet assembly with a first groove; and wherein axially engaging the third tubular member of the at least one jumper tube with the transport tube of the second joint further comprises engaging a second collet assembly with a second groove.

18. The method as recited in claim 15, wherein axially engaging the second tubular member of the at least one jumper tube with the transport tube of the first joint further comprises engaging a first locking ring with a first groove; and wherein axially engaging the third tubular member of the at least one jumper tube with the transport tube of the second joint further comprises engaging a second locking ring with a second groove.

19. The method as recited in claim 15, wherein engaging the second tubular member of the at least one jumper tube with the transport tube of the first joint further comprises disposing the second tubular member of the at least one jumper tube to the interior of the transport tube of the first joint; and wherein axially engaging the third tubular member of the at least one jumper tube with the transport tube of the second joint further comprises disposing the third tubular member of the at least one jumper tube to the interior of the transport tube of the second joint.

20. The method as recited in claim 15, wherein engaging the second tubular member of the at least one jumper tube with the transport tube of the first joint further comprises positioning at least a portion of the second tubular member of the at least one jumper tube to the exterior of the transport tube of the first joint; and wherein axially engaging the third tubular member of the at least one jumper tube with the transport tube of the second joint further comprises positioning at least a portion of the third tubular member of the at least one jumper tube to the exterior of the transport tube of the second joint.

* * * * *